US009463630B2

(12) United States Patent
Thayer

(10) Patent No.: US 9,463,630 B2
(45) Date of Patent: Oct. 11, 2016

(54) SYSTEM AND METHOD FOR CLEANING AN INKJET PRINTER

(71) Applicant: Xerox Corporation, Norwalk, CT (US)

(72) Inventor: Bruce E. Thayer, Spencreport, NY (US)

(73) Assignee: Xerox Corporation, Norwalk, CT (US)

( * ) Notice: Subject to any disclaimer, the term of this patent is extended or adjusted under 35 U.S.C. 154(b) by 28 days.

(21) Appl. No.: 14/638,384

(22) Filed: Mar. 4, 2015

(65) Prior Publication Data

US 2016/0257122 A1 Sep. 8, 2016

(51) Int. Cl.
*B41J 2/165* (2006.01)

(52) U.S. Cl.
CPC ..... *B41J 2/16538* (2013.01)

(58) Field of Classification Search
None
See application file for complete search history.

(56) References Cited

U.S. PATENT DOCUMENTS 3,468,248 A 9/1969 Giori
5,606,354 A * 2/1997 Bekki ..... B41J 2/16547 347/33
5,969,731 A * 10/1999 Michael ..... B41J 2/16535 347/33
2003/0156868 A1 8/2003 Shin et al.
2006/0221122 A1* 10/2006 Kwon ..... B41J 2/16552 347/30
2010/0251916 A1 10/2010 Peles et al.

FOREIGN PATENT DOCUMENTS

| | | | |
|---|---|---|---|
| EP | 0 858 010 | A1 | 8/1998 |
| EP | 2 075 648 | A2 | 7/2009 |
| EP | 2 281 691 | A1 | 2/2011 |
| JP | S58-82277 | A | 5/1983 |
| JP | 2004-271833 | A | 9/2001 |

* cited by examiner

*Primary Examiner* — Alejandro Valencia
(74) *Attorney, Agent, or Firm* — Maginot Moore & Beck LLP

(57) ABSTRACT

A printer cleaning device includes a cleaning blade that is operatively disposed on a cleaning surface to contact and remove a material from the cleaning surface. The cleaning blade has a body portion and a cleaning edge adjoining the body portion adapted to contact the cleaning surface. The printer cleaning device further includes a pad that is attached to the body portion of the cleaning blade and is disposed across a predetermined length of the cleaning blade. The pad has a first corner that is located at a first end of the body portion wherein the first end is at a predetermined distance from the cleaning edge. The printer cleaning device further includes a controller configured to control the cleaning blade to contact and wipe the cleaning surface.

9 Claims, 5 Drawing Sheets

SYSTEM AND METHOD FOR CLEANING AN INKJET PRINTER

TECHNICAL FIELD

This disclosure relates generally to systems for cleaning surfaces in printers, and more particularly, to systems for cleaning surfaces in printers with a wiper blade.

BACKGROUND

In general, inkjet printing machines or printers include a device that removes materials from an image forming surface. In previously known aqueous printers, the cleaning device includes a foam roller followed by a separate squeegee blade to remove ink from a thin skin layer on the surface. However, a portion of the water accumulates in front of these cleaning devices when the squeegee blade is retracted. The accumulated water remains on the image forming surface after the squeegee blade is retracted.

Some previously known printers employ techniques, such as changing the angle of the squeegee blade, to reduce the amount of water remaining on the surface. However, because the skin on the surface of certain aqueous printers contains a surfactant, the water accumulating in front of the squeegee blade can become contaminated and its wetting properties can change. This contamination can reduce the effectiveness of changing the angle of the blade. Other previously known printers implement techniques, such as increasing the amount of time between retraction of the foam roller and the retraction of the squeegee blade, to allow for more time for the water bead in front of the squeegee blade to drain down the squeegee blade after input of water from the foam roller has stopped. However, water still remains on the surface after the squeegee blade is retracted. Furthermore, changes in the cleaning device orientation relative to gravity have similar effects on the accumulations of water in front of the squeegee blade.

In other previously known printers, the cleaning device includes a foam roller to apply oil to a surface and a wiper blade to meter the oil to a desired thickness. The wiper blade accumulates a bead of oil in front of the blade. When the blade is retracted, the oil bead remains and produces a band or bar on prints. Previously known printers are unable to eliminate the released oil bead. As such, some previously known printers employ techniques to minimize the amount of oil released and constrain the process by retracting the blade at a position that enables the oil bar to be positioned in a non-imaging area for minimum print quality degradation. However, this constraint in the process has an impact on productivity, especially with changes in media size. As such, improvements in inkjet printers that enable cleaning of the imaging surface are desirable.

SUMMARY

A printer cleaning device has been configured to enable the removal of material from a cleaning surface of a printer. The printer cleaning device includes a blade having a body that terminates into an edge, an actuator operatively connected to the blade to move the blade into and out of engagement with a surface to remove selectively a material from the surface, an absorbent pad attached to the body of the blade and disposed across a predetermined length of the cleaning blade, the absorbent pad being positioned at a predetermined distance from the edge of the blade, and a controller operatively connected to the actuator, the controller being configured to operate the actuator to move the blade into and out of engagement with the surface to remove material from the surface selectively.

A new method of printer cleaning operation that enables removal of material from a cleaning surface of a printer. The method includes operating a blade using a controller to position the blade to contact an edge of the blade with a surface of the printer, the blade having a body portion to which a pad is attached and disposed across a predetermined length of the blade to enable a first corner of the pad to be located at a first end of the body portion at a predetermined distance from the edge of the blade, the operating of the blade includes compressing the pad on the surface to release a cleaning fluid against the first corner of the pad and the surface.

BRIEF DESCRIPTION OF THE DRAWINGS

The foregoing aspects and other features of a printer cleaning device that removes a material are explained in the following description, taken in connection with the accompanying drawings.

DETAILED DESCRIPTION

Figure 1:
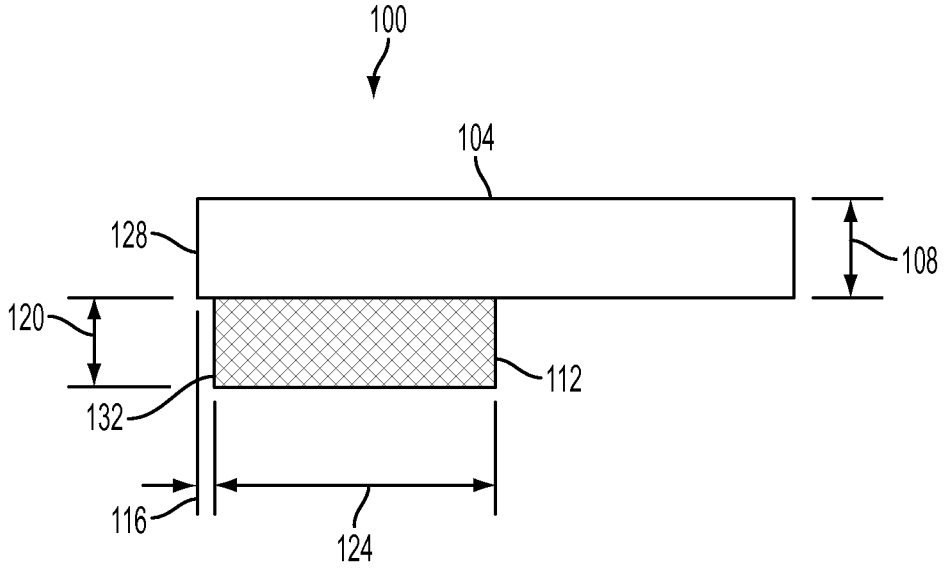
FIG. 1 is an exemplary printer cleaning device.

For a general understanding of the present embodiments, reference is made to the drawings. In the drawings, like reference numerals have been used throughout to designate like elements.

FIG. 1 illustrates an exemplary printer cleaning device 100. The printer cleaning device 100 includes a blade 104. The blade 104 comprises a body with a cleaning edge 128. A pad 112 is attached to the blade 104 across a predetermined length 124 of the body of the blade 104. The pad 112 can be attached to the blade 104 using a material, examples of which include, but are not limited to, a double-back adhesive tape, appropriate glue, spray adhesive, or the like. The pad 112 consists of an applicator edge 132 that engages with the cleaning surface of the printer during the cleaning process. The applicator edge 132 of the pad 112 is offset at a predetermined distance 116 from the cleaning edge 128 of the blade 104. The offset 116 enables the blade 104 to engage with the cleaning surface of the printer during the cleaning process without interference from the pad 112.

In one example, an applicator positioned downstream from the cleaning device 100 deposits cleaning fluid onto the surface and most of the cleaning fluid is removed from the surface by blade 104 and directed to, for example, a waste collector. A portion of the cleaning fluid remaining on the cleaned surface saturates the pad 112 as the cleaning device 100 remains engaged with the cleaned surface. The downstream applicator stops depositing cleaning fluid onto the surface prior to the retraction of the blade 104. When the blade 104 retracts from contact with the cleaning surface, the compressed pad 112 expands. The volume of the expanded pad 112 enables the pad 112 to absorb a portion of the cleaning fluid remaining on the surface along with any other material freed from the surface by the blade 104. When the blade 104 reengages with the surface of the printer, the pad 112 compresses and expels a portion of the absorbed cleaning fluid from the pad onto the surface being cleaned. The expelled cleaning fluid does not significantly contribute to the amount of the cleaning fluid used to clean the surface. The expelled portion of cleaning fluid replenishes the capacity of the pad 112 to absorb a bead of cleaning fluid in front of the blade 104 when the blade 104 is again retracted from the cleaning surface and the pad expands. Absorbing a portion of the accumulated cleaning fluid enables the pad 112 to dry the surface being cleaned to some degree. To further dry the cleaning surface, additional equipment such as an air knife, a blade, a combination of both, or the like can be used. The cleaning fluid can be any known solvent for removing a material or a combination of materials such as inks, skin layers, release agents, or the like. Examples of the cleaning fluid include, but are not limited to, water, water with surfactants, oil, hydrocarbon solvents, or the like.

The blade 104 has a predetermined thickness or height 108 and the pad 112 has a predetermined thickness or height 120 useful for cleaning a surface in the printer. The blade 104 engages with the surface at a predetermined angle. In one example, the predetermined angle and the predetermined height 120 are determined by setting the volume of the pad 112 compression to at least equal to the volume of a portion of the cleaning fluid, material, or a combination of both the fluid and material that accumulates in front of the blade 104. In one example, the thickness 120 of the pad 112 is about 2 to 3 mm, preferably about 3 mm. The offset 116 is about 0.5 mm, the thickness 108 of the blade 104 is about 2 mm, and the pad 112 is attached to the blade 104 across a length 124 of about 5 to 10 mm. The reader should understand that while specific ranges are described herein, any other suitable ranges and values can be used for the design of the blade 104 and the pad 112.

The pad 112 is made up of a material such as a foam strip material. In one example, the foam strip material can be relatively thin and swell only a little when the cleaning fluid is absorbed. Examples of a foam strip material that swells an appropriate amount include, but are not limited to, polyurethane foams, polymer foams, or the like. The foam strip material can be fabricated from open cell material having a relatively high pore density. The foam strip material of the pad 112 can be either hydrophilic or hydrophobic depending on the nature of material that needs to be cleaned from the surface in the printer. For example, using a hydrophilic foam pad 112 to clean aqueous ink from a surface results in an accumulation of ink in the pad 112 because aqueous ink is not easily rinsed out of a hydrophilic pad 112.

Additionally or alternatively, the pad 112 has compression stiffness or compression strength to enable the pad 112 to be compressed against the surface being cleaned. The pad 112 can have a relatively low compression stiffness to enable the pad 112 to be compressed against the cleaning surface with a little additional force applied to the end of the blade 104. Additionally, the pad 112 can have a relatively high rebound to enable the pad 112 to expand quickly and return to its original shape when the blade 104 is retracted. The reader should understand that high rebound can also be known as low hysteresis loss during compression cycles.

Additionally or alternatively, the pad 112 is chemically resistant to materials to be removed from a surface by the pad 112. Examples of materials to be removed include, but are not limited to, ink, dust, debris, chemicals, cleaning fluid, or the like. Additionally, the pad 112 has relatively high water absorption to enable the pad 112 to absorb a higher capacity of the cleaning fluid or other materials from the cleaning surface of the printer.

Figure 2:
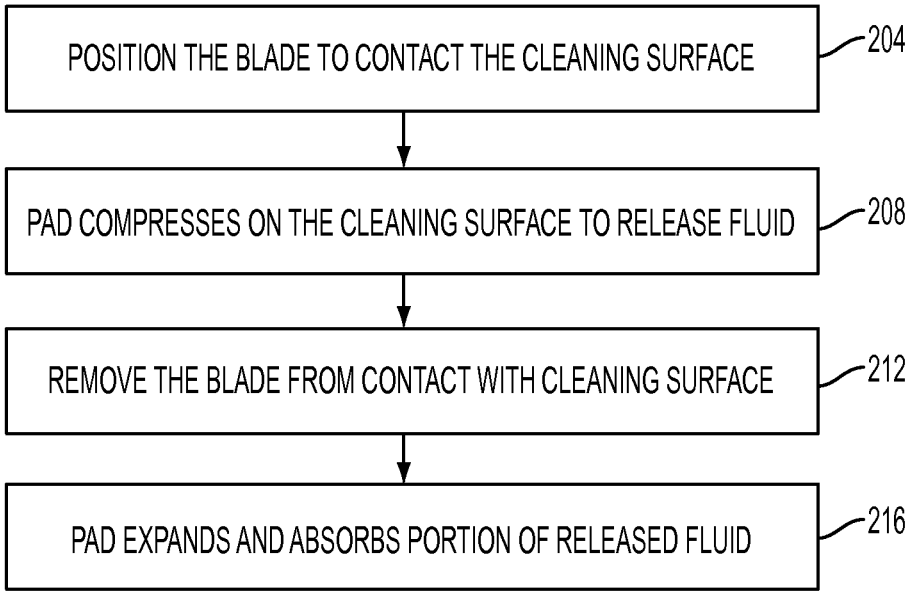
FIG. 2 is an exemplary process of cleaning a cleaning surface of a printer using the printer cleaning device.
Figure 3A:
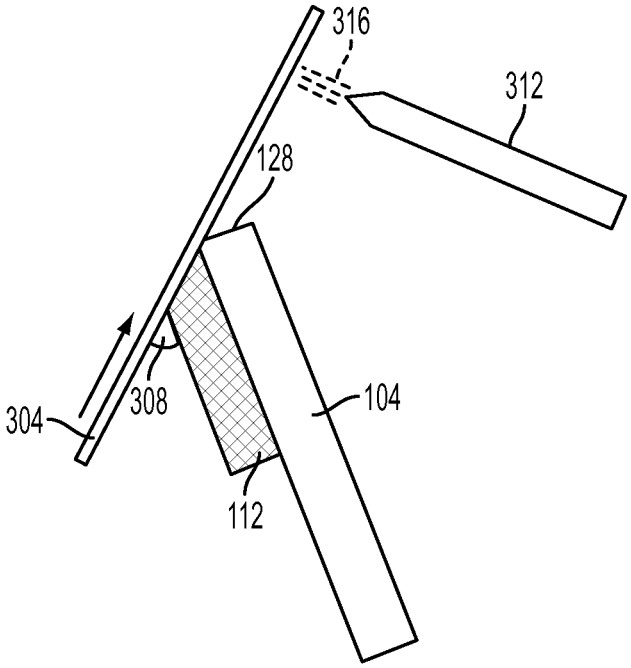
FIG. 3A is an exemplary device engaging with the cleaning surface of the printer during the process illustrated in FIG. 2.
Figure 3B:
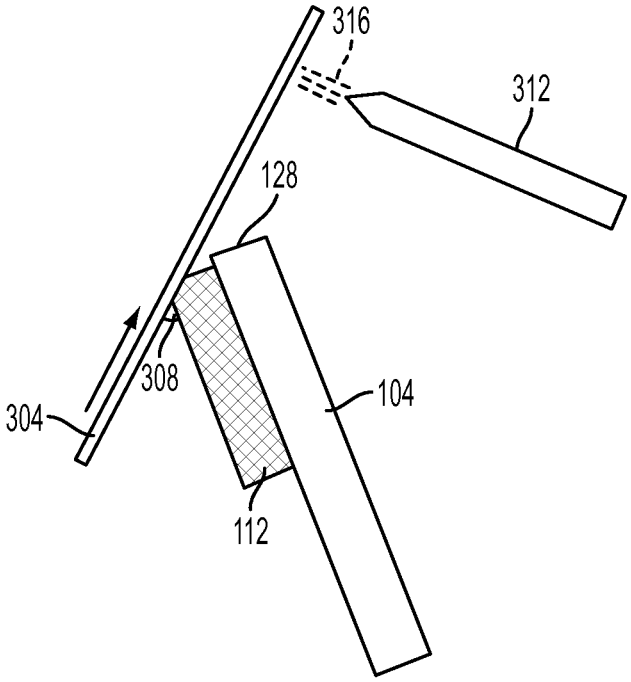
FIG. 3B depicts an exemplary blade partially retracted from contact with the cleaning surface during the process illustrated in FIG. 2.
Figure 3C:
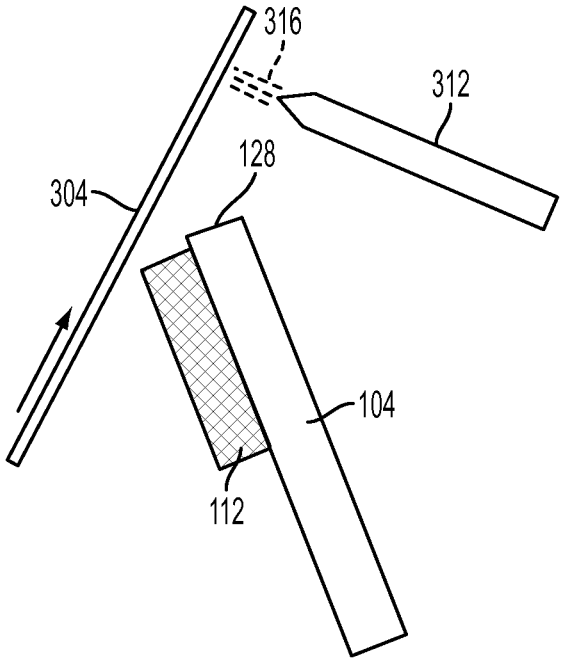
FIG. 3C depicts an exemplary blade completely retracted from contact with the cleaning surface during the process illustrated in FIG. 2.

FIG. 2 illustrates an exemplary process of cleaning a surface in a printer using the printer cleaning device 100. In the exemplary process, an actuator positions the cleaning device 100 to engage the surface to be cleaned with the blade 104 (block 204). The actuator is connected to the blade 104 and a controller to enable the controller to operate the actuator and move the blade 104 into and out of engagement with the surface. FIG. 3A, FIG. 3B, and FIG. 3C depict an exemplary device 100 engaging with the surface 304 of the printer during the process illustrated in FIG. 2. As illustrated in FIG. 3A, the actuator can position the device 100 to contact the surface 304 at a predetermined angle. The cleaning surface 304 moves in a direction opposite to the motion of the blade 104 coming into engagement with the surface.

When the edge 128 of the blade 104 engages the surface 304, a portion of the pad 112 compresses against the surface 304. A portion of the pad 112, for example, the applicator edge of the pad 112, can be saturated with cleaning fluid prior to the engagement of the blade 104 with the surface 304. FIG. 3A further illustrates the compressed pad 112 expelling a portion of the cleaning fluid 308 onto the surface 304 (block 208). The expelled cleaning fluid 308 can accumulate in front of the blade 104 and the pad 112. Additionally, the blade 104 continues to remain in a state of contact with the cleaning surface 304 for a predetermined amount of time to enable the expelled cleaning fluid 308 to travel from the applicator edge of the pad 112 to the contact edge of the blade 104. During this predetermined amount of time, the amount of cleaning fluid 308 accumulated in front of the blade 104 and the pad 112 may decrease in volume.

The actuator retracts the blade 104 from contact with the surface 304 (block 212). As the blade 104 retracts from contact, the pad 112 expands as the compression against the surface 304 decreases. The expansion of the pad 112 allows a portion of the accumulated cleaning fluid 308 to be drawn into the pad 112 due to expanding voids in the pad 112 (block 216). As such, by absorbing the accumulated cleaning fluid 308 as the blade 104 retracts, the pad 112 prevents the accumulated cleaning fluid 308 from remaining on the surface 304 after the blade 104 is retracted. FIG. 3B depicts the blade 104 partially retracted from contact with the surface 304 and a portion of the accumulated fluid 308 is absorbed into the pad 112. In one example, if the pad 112 has sufficient capacity, then it can absorb most of the expelled cleaning fluid 308 from the surface 304 and the surface 304 is left relatively dry. FIG. 3C depicts the blade 104 completely retracted from contact with the surface 304 and most of the accumulated fluid 308 has been absorbed into the pad 112. To absorb most of the expelled cleaning fluid 308, the volume of fluid that can be absorbed by the pad 112 when the pad 112 is retracted must be at least as much as the volume of expelled cleaning fluid 308. This volume can be a function of the water absorption property and the compression volume property of the pad 112. The compression volume of the pad 112 can be determined by the thickness 120 of the pad 112, the offset 116 of the pad 112 from the blade 103, and the angle of contact of the blade 104 with the surface 304. The reader should understand that the volume can be a function of other properties of the pad 112 or the device 100 as well. Additionally, an air knife 312 can be used to direct air flow 316 towards the surface 304 and further dry the surface 304.

EXAMPLES

The following example of the printer cleaning device 100 is to be considered illustrative in nature, and is not limiting in any way.

Example 1

In this example, a small bench fixture is used to clean a surface. The fixture comprises a glass tube that is about 4 inches long and about 1.5 inches in diameter. The glass tube is connected, through a coupling, to a motor to enable the glass tube to rotate. A pivoting blade holder is connected to the fixture so the blade swings into contact with the rotating glass tube. The blade is a Synztec 238707 blade, which is a urethane cleaning blade and is about an inch long. The blade 104 is oriented in a wiper mode and angled in order to wipe and clean materials from the surface of the rotating glass tube. In Trial 1 and Trial 2, no pad 112 is attached to the blade 104 and a water bottle is used to squirt water onto the surface of the rotating glass tube. Without an attached pad 112, the blade is used as a squeegee to clean the surface of the glass tube. In Trial 3, a pad 112 is attached to the blade 104. The following trials are conducted on this structure:

Trial 1

This trial illustrates the functioning of the blade, such as blade 104 described above, without an attached pad, such as pad 112 discussed above. In this trial, after the water is squirted on the rotating glass tube, the pivoting blade holder swings the blade into engagement with the glass tube. When the blade engages with the surface of the glass tube, the squirted water is wiped from the surface of the glass tube and accumulates in front of the blade as a bead of water. A small slip of paper is held in contact with the surface of the glass tube to detect moisture on the surface of the glass tube. Paper is used because it is absorbent and allows for a visual inspection of whether the glass tube is dry. In this trial, when the load of the blade was sufficiently high, water was not detected on the surface of the glass tube since the paper did not become wet. As a result, when the load of the blade was sufficiently high, the surface of the glass surface was dry. However, when the load of the blade was relatively low, water was detected on the glass tube and the paper absorbed a very thin film of water escaping under the blade. The paper turned dark as a result of absorbing the thin film of water from the surface of the glass tube.

Trial 2

This trial illustrates the release of the water when the blade is retracted from contact with the surface of the glass tube when a pad is not attached to the blade. In this trial, water is reapplied to the surface of the glass tube. The pivoting blade holder swings the blade into engagement with the glass tube with sufficient pressure to dry the glass tube. A slip of paper is then held against the surface of the glass tube after the blade retracts from contact. The paper is used to verify that the surface of the glass surface is dried by the blade. In this trial, when the blade was retracted from contract with the surface of the glass tube, the paper turned dark, which indicates a release of the bead of water from the blade.

Trial 3

This trial illustrates the functioning of blade, such as blade 104 described above, when a pad, such as pad 112, is attached to the blade. The pad is a 3 mm thick foam strip and is cut using a scalpel blade. The pad is attached with double back tape to the blade and mounted as close to the edge of the blade as possible without interfering with the edge of the blade. In this trial, water is applied to the surface of the glass tube. The pivoting blade holder swings the blade into engagement with the glass tube with sufficient pressure to dry the glass tube. The paper slip is used to detect moisture on the surface of the glass tube after the blade retracts from the surface of the glass tube. The paper indicated that the surface of the glass tube was dry. This trial illustrates that the pad absorbed a portion of the cleaning fluid as the blade retracted from contact with the cleaning surface. This trial was performed a number of times using TMP CapuCell, hydrophilic, Ultra-Fine, and hydrophobic foam materials and positive results were observed after the blade 104 retracted from contact with the cleaning surface.

The reader should understand that the cleaning device 100 having a blade 104 and an absorbent pad 112 can be used in other systems as well. Examples of such system include, but are not limited to, solid inkjet (SIJ) printers, indirect inkjet printing, such as Landa Nanography, non-printing systems, and the like. The cleaning device 100 can be used to clean imaging surfaces as well as other types of surfaces to which ink and other printing materials may attach.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer cleaning device comprising:

a blade having a body that terminates into an edge;

an actuator operatively connected to the blade to move the edge of the blade into and out of engagement with a surface to remove selectively a material from the surface with the edge;

an absorbent pad attached to the body of the blade and disposed across a predetermined length of the cleaning blade, the absorbent pad being positioned at a predetermined distance from the edge of the blade and located on the body to enable the absorbent pad to engage the surface and be compressed between the body of the blade and the surface as the edge of the blade engages the surface; and a controller operatively connected to the actuator, the controller being configured to operate the actuator to move the edge of the blade into engagement with the surface to remove material from the surface and compress the absorbent pad between the body of the blade and the surface to expel fluid from the absorbent pad onto the surface and to move the edge of the blade out of engagement with the surface to enable the absorbent pad to expand and absorb fluid from the surface.

2. The printer cleaning device of claim 1, wherein the predetermined distance enables the edge of the blade to engage the surface without engaging the compressed absorbent pad.

3. The printer cleaning device of claim 2 further comprising:

a supply of solvent fluidly connected to the absorbent pad to enable the absorbent pad to apply solvent to the surface and facilitate the removal of the material.

4. The printer cleaning device of claim 3, wherein the absorbent pad is a resilient porous material.

5. The printer cleaning device of claim 1 further comprising:

an air knife configured to direct an air flow towards the surface and the air knife is positioned to direct the air flow towards the surface after the blade and the absorbent pad are disengaged from the surface.

6. The printer cleaning device of claim 1, wherein the pad has a predetermined height and the blade engages the surface with a predetermined angle.

7. The printer cleaning device of claim 6, wherein the predetermined height and the predetermined angle are determined by setting a volume of compression of the pad to at least equal to a volume of a portion of material that accumulates in front of the blade.

8. The printer cleaning device of claim 1, wherein the absorbent pad consists essentially of a hydrophilic foam or a hydrophobic foam.

9. The printer cleaning device of claim 8, wherein the hydrophilic or hydrophobic foam is a polymer foam.

* * * * *